US005479950A

United States Patent [19]

Andrews

[11] Patent Number: 5,479,950

[45] Date of Patent: Jan. 2, 1996

[54] FINGER TIP MUSTACHE SHAVING DEVICE WITH COVER

[76] Inventor: Edward A. Andrews, 6835 Beach Rd., Troy, Mich. 48098

[21] Appl. No.: 319,149

[22] Filed: Oct. 6, 1994

Related U.S. Application Data

[63] Continuation of Ser. No. 20,586, Feb. 22, 1993, abandoned.

[51] Int. Cl.[6] ..... B26B 21/00; A45D 2/50

[52] U.S. Cl. ..... 132/215; 132/289; 30/32; 30/84; 30/85

[58] Field of Search ..... 132/215, 214, 132/148, 289; 30/30, 32, 48, 49, 55, 58, 76, 84, 85

[56] References Cited

U.S. PATENT DOCUMENTS

| | | | |
|---|---|---|---|
| D. 159,994 | 9/1950 | Lee | 30/30 |
| 778,388 | 12/1904 | Warren | 30/32 |
| 779,233 | 1/1905 | Morgan . | |
| 839,447 | 12/1906 | Arnold | 30/53 |
| 1,044,906 | 11/1912 | Ohlsson . | |
| 1,217,288 | 2/1917 | Donnelly | 30/53 |
| 1,643,757 | 9/1927 | Wallenbeck | 30/30 |
| 1,976,290 | 10/1934 | Motley | 30/30 |
| 2,547,376 | 4/1951 | Crawford . | |
| 2,633,635 | 4/1953 | North | 30/30 |
| 2,804,684 | 9/1957 | Talamonti . | |
| 2,866,984 | 1/1959 | Plough | 30/30 |
| 3,488,764 | 1/1970 | Welsh | 30/50 |
| 3,536,080 | 10/1970 | Player . | |
| 3,557,448 | 1/1971 | Shead | 30/30 |
| 3,613,233 | 10/1971 | Lundell | 30/30 |
| 3,621,569 | 11/1971 | Morris | 30/30 |
| 4,319,399 | 3/1982 | Ciaffone | 30/30 |
| 4,344,226 | 8/1982 | Blake III | 30/31 |
| 4,441,252 | 4/1984 | Caves | 30/53 |
| 4,622,742 | 11/1986 | Lee | 30/55 |
| 4,663,841 | 5/1987 | Luster | 30/30 |
| 4,709,475 | 12/1987 | Phung . | |
| 4,782,590 | 11/1988 | Pope | 30/30 |
| 4,888,868 | 12/1989 | Pritchard | 132/289 |
| 4,928,716 | 5/1990 | Greene | 132/215 |
| 4,961,262 | 10/1990 | Lawrence . | |
| 5,009,003 | 4/1991 | Grange | 30/30 |

FOREIGN PATENT DOCUMENTS

| | | | |
|---|---|---|---|
| 2311634 | 12/1976 | France | 30/30 |
| 802752 | 10/1958 | United Kingdom | 30/30 |

*Primary Examiner*—John G. Weiss
*Attorney, Agent, or Firm*—Harness, Dickey & Pierce

[57] ABSTRACT

A small-size lightweight mustache shaving device, grippable between a user's forefinger and thumb, for enabling the user to precisely shave and edge his own mustache to a desired shape. The device is formed as an elongated flat narrow body having a forward head portion and an integral offset rear fingertip-grip portion. A small elongated flat razor blade strip is mounted upon the head portion and has its razor sharp edge extending laterally outwardly from the head portion. The razor-sharp blade edge of the device is placed by the user against his skin and/or mustache adjacent the periphery of the desired mustache line and then manually moved under fingertip control to shave and shape the hairs of the user's mustache. Several embodiments of the device are disclosed, including guarded, blunted and assembled blade designs, and all-metal designs. An optional removable cover fits over the head portion and encases the blade sharp edge and is frictionally held upon the head portion for manual removal and replacement.

20 Claims, 2 Drawing Sheets

FINGER TIP MUSTACHE SHAVING DEVICE WITH COVER

CROSS-REFERENCE TO RELATED APPLICATION

This application is a continuation of U.S. patent application Ser. No. 08/020,586, filed Feb. 22, 1993, now abandoned.

FIELD OF THE INVENTION

This invention relates in general to mustache shaping devices, and in particular to small, lightweight mustache shaping devices which can easily be gripped by and between a user's fingertips for precise mustache cutting and shaping.

BACKGROUND OF INVENTION

It is a common practice to trim the hair forming a mustache with scissors or with an electric mustache trimmer device. However, it is difficult to shape the upper and lower peripheral edges of a mustache with either a scissors or an electric trimmer. Further, these devices are relatively expensive.

Thus, there has been a need for some simple, inexpensive, lightweight device for enabling an individual to easily and accurately shape his own mustache and to do so when the mustache hair is wet and lathered. In addition, it would be desirable to have an instrument which is sufficiently inexpensive so that it may be discarded and replaced frequently. This enables the user to always have a device with a sharp razor edge whenever it is used, thereby providing optimum cutting and trimming performance.

This invention relates to a simplified mustache shaping device which is so small and lightweight that it can be easily gripped between the user's fingertips for precise cutting and shaping of the peripheral edges of a mustache.

SUMMARY OF INVENTION

This invention contemplates providing a mustache shaping device in the form of an elongated, narrow, body or strip having one end formed as a fingertip-grip portion and the opposite end formed as a cutter end or head portion. One side of the head is provided with a channel within which a narrow metal strip, or blade is mounted. The blade has a sharpened edge which extends outwardly of the channel so that the edge is exposed along a longitudinal side of the head.

An object of this invention is to provide a simplified, sharp edged, device which is small in size and lightweight and formed so as to be easily held between the user's thumb and forefinger and easily manipulated by the user for precisely shaping his mustache. Particularly the device is useful for precisely shaping the upper edge periphery of the mustache beneath the user's nose including the sloped areas of the naso labial fold located between the nose and upper lip. Moreover, the shaping device is sufficiently inexpensive in construction that it may be readily discarded and replaced after a limited number of uses thus allowing the use of a device with a new, sharp razor edge, which is more effectively able to precisely trim and shape the periphery of the mustache.

Another object of this invention is to provide a shaping device having a cutter head and an integral handle portion which may be gripped between the user's fingertips, and a thin metal strip having a sharp edge mounted on the head, with a manually removable and replaceable, plastic cover which fits over, and is frictionally held upon, the cutter head for encasing the sharp edge.

These and other objects and advantages of this invention will become apparent upon reading the following description, of which the attached drawings form a part.

DETAILED DESCRIPTION

Figure 1:
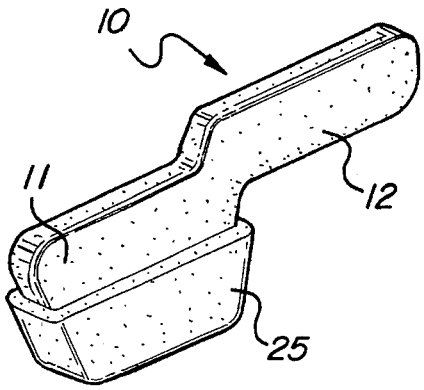
FIG. 1 is a perspective view of a mustache shaping device with its head cover enclosing the blade sharp edge.
Figure 2:
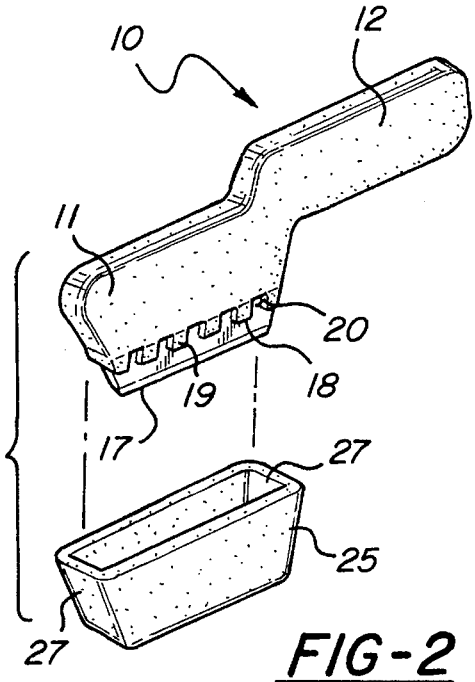
FIG. 2 is a perspective view of the device with the head cover removed.
Figure 3:
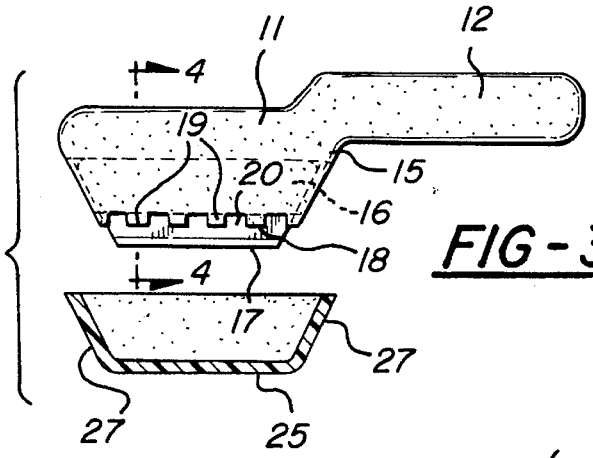
FIG. 3 is a side elevational view of the device with the cover removed and with the cover shown in cross-section.
Figure 4:
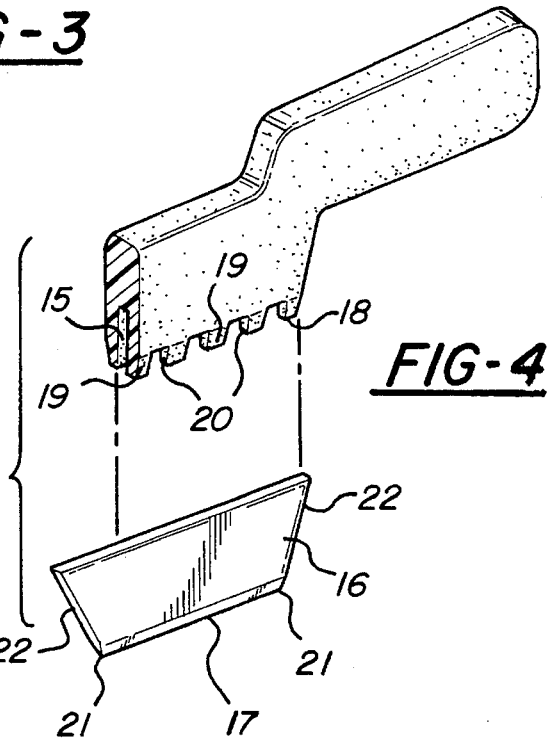
FIG. 4 is a perspective view, taken in the direction of arrows 4—4 of FIG. 3, showing the blade disassembled from the head of the instrument.
Figure 5:
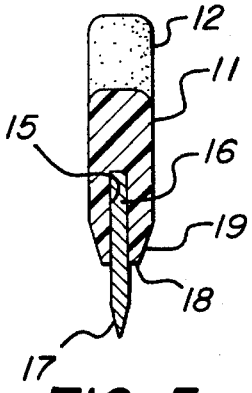
FIG. 5 is an enlarged cross-sectional view of the device head.
Figure 6:
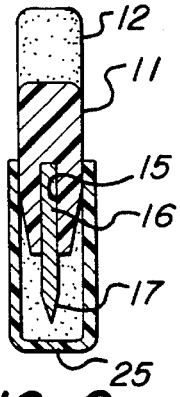
FIG. 6 is a cross-sectional elevational view, similar to FIG. 5, but showing the cover in position upon the head.

FIGS. 1–6 illustrate a mustache shaping and trimming device having an elongated, flattened body 10. The body may be made of a molded plastic material or of a metal stamping or casting. The body of the device is divided into a head portion 11 and an integral finger grip portion 12. As shown in FIG. 1–3 of the drawings, the head portion 11 and the fingertip portion 12 are approximately the same length. Therefore, head portion 11 and the integral fingertip portion 12 are each approximately one half of the overall length, so that the body 10 is divided roughly in half into a forward cutter end portion and an integral rear grip portion. The overall length of the device is relatively small, as for example, on the order of 2 to 2½ inches long with the blade roughly ¾ inches long. In addition, the grip portion may be axially aligned with the head.

The small overall size of the device permits fingertip holding, which results in better control of the cutting action. This enables the user to precision shape his mustache. Precise or detailed control and positioning is further facilitated by the light weight of the device.

The head 11 is provided with a slot-like channel 15 which extends its full length. A single edge, flat, narrow, strip steel blade 16 is inserted in the channel 15 and is fastened therein. The blade may be fastened in place during the molding of the plastic head. The blade has a sharpened edge 17 which extends laterally outwardly of the longitudinal edges 18 which define the channel 15. The free edges of the channel may be straight or may be provided with fingers 19 separated by notches 20.

The corners 21 that are formed at the opposite ends of the edge 17, of the strip-like blade 16, are blunted. This may be accomplished by angling the opposite blade ends 22 at an obtuse angle relative to the blade sharpened edge 17. Otherwise, the corners 21 may be blunted by rounding them somewhat. This blunting enables the user to apply greater pressure on the sharp edge of the blade to enhance the cutting action while trimming and shaping the mustache, without puncturing the skin. The blade length is long enough to easily maintain a repeated straight edge cut. However, it is short enough, so that it can easily allow cutting convex or concave, as well as straight, lines for various mustache shapes or trimming the sloping areas of the naso labial fold between the user's upper lip and nose.

The mustache shaper system includes a narrow trough shaped plastic cover 25 for covering the sharp edge and the adjacent portions of the head. The opposite ends 27 of the cap are closed for closely containing the sloped ends of the head. Alternatively, one or both of such ends may be open. The cover is shaped and sized to snugly fit over, and to grip, the head frictionally. Thus, it may be removed forcibly by manually pulling it off the head or it may be manually pushed into position upon the head for covering and protecting the head and blade when desired.

With the construction shown, the user may shape his mustache by gripping the grip portion between the tips of his thumb and forefinger and then controllably moving the blade edge upon the peripheral edges of the mustache hairs. This enables the user to precisely shape the mustache upper and lower peripheral edges located near the nose and above the lip, such as for forming a "pencil" style mustache or the like. Since the blade is short, it can easily shape the hair in the facial depression above the upper lip and shape the hair evenly on both sides of the mustache to any desired design.

The instrument may be used once or a number of times. Because of its low cost and relatively small size, the instrument can be disposable, that is, it can be thrown away after a few uses and replaced with a like device.

Preferably, the body of the device is molded of a suitable, conventional plastic. The blade, in that case, may be held in the channel by the plastic material that is molded around it. However, the blade may be placed within a pre-molded body and then secured within the channel in the head by some suitable adhesive mechanical fastening means.

Figure 7:
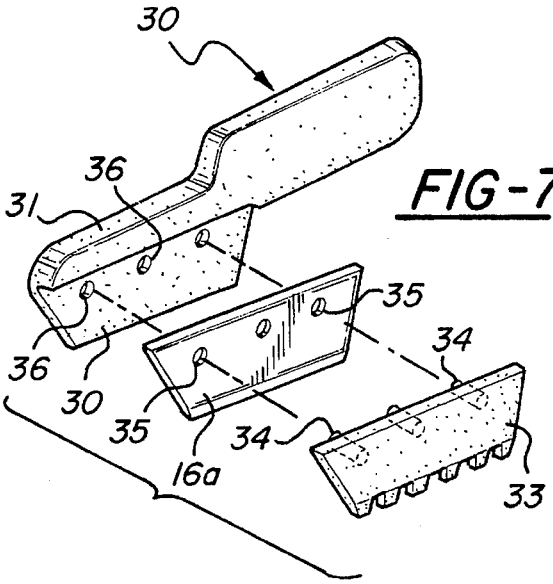
FIG. 7 is a perspective view of a modified device with the blade separated from the body of the device for illustration purposes.

FIG. 7 shows a modified device wherein the blade 16 is positioned against an exposed surface 30 formed on the head 31 of a body 32. The body may be made of molded plastic, or cast metal or the like. The blade **16*a* may be fastened to the body by a flat bar 33 having integral pins 34 which extend through openings 35 in the blade and are seated corresponding holes or sockets 36 formed in surface 30 of the head 31**. The pins may be press fitted into the holes for frictional fastening therein or may otherwise be fastened within the holes.

Figure 8:
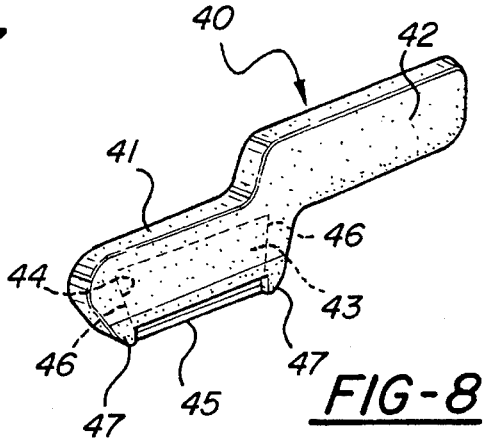
FIG. 8 is a perspective view of a modified device in which the corners of the blade are covered.

FIG. 8 illustrates a modified device 40 having a head 41 and fingertip 42. The blade 43 is encased within a pocket 44 formed in the head so that the sharp edge 45 of the blade is exposed, but the corners at the ends 46 of the blade are covered by extensions 47. The device may be formed of a plastic molding with the blade embedded in the head during the molding process.

Figure 10:
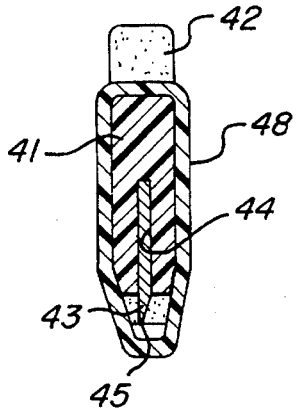
FIG. 10 is an enlarged cross-sectional view taken in the direction of arrows 10—10 of FIG. 9 with the cover in position.
Figure 9:
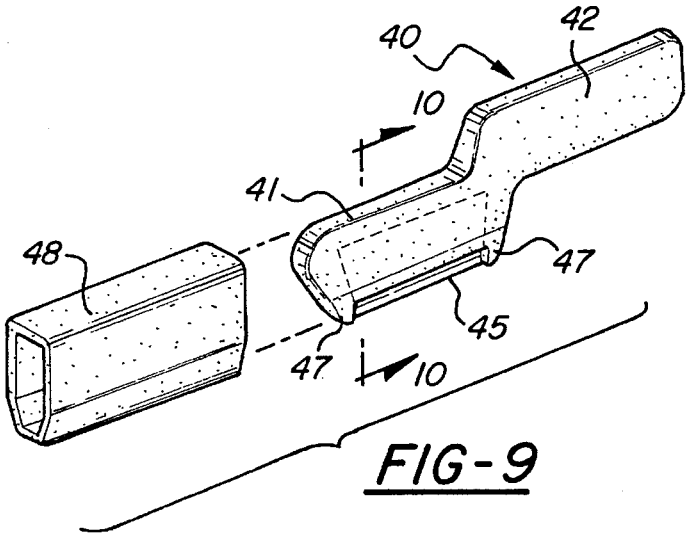
FIG. 9 is a perspective view of the device of FIG. 8 with a sleeve type of cover shown removed.

FIGS. 9 and 10 illustrate the application of a sleeve-like cover 48 over the head 41 of the device 40. The cover may be an open ended tube, as illustrated, or have one closed end. As illustrated in FIG. 10, the cross-sectional shape of the cover may be formed to conform to and snugly fit over the head 41, so that the cover is frictionally held upon the head and covers the exposed sharp edge 45 of the blade 43.

Figure 11:
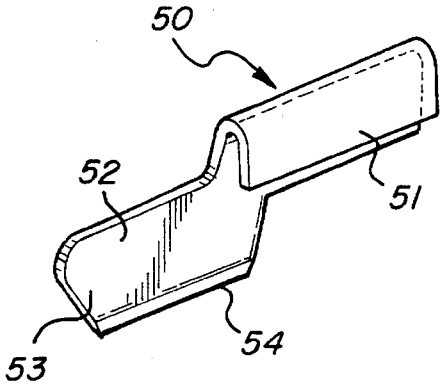
FIG. 11 is a perspective view of a modified device formed of bent sheet metal.

FIG. 11 is a perspective view of a mustache shaping device 50 which is formed of a single sheet of metal bent or stamped into a double bent, fingertip grip portion 51 and a head 52 which forms a blade portion 53, whose free edge 54 is sharpened to form a sharp cutting edge.

Figure 12:
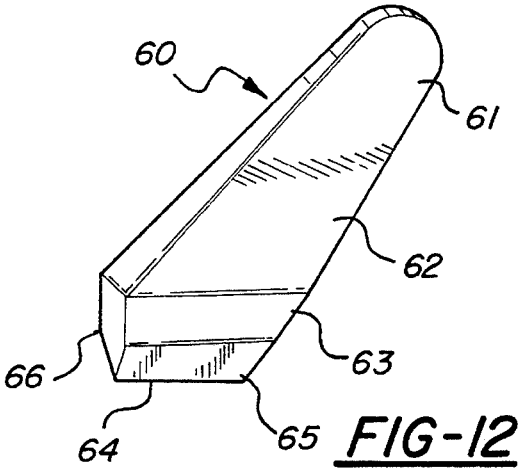
FIG. 12 is a perspective view of a modified device formed of sintered metal, such as a hard carbide.

FIG. 12 illustrates a one-piece, bar-like mustache shaping device 60. The device may be made of sintered metal material, such as, a hard carbide, using conventional sintering and molding techniques. One end of the device provides the fingertip grip portion 61 and the opposite end forms the head portion 62. The free end 63 of the head may be bevelled with a sharpened cutting edge 64 ground upon the edge of the bevel 65. Preferably, the bevelled free end is angled relative to the bar, as illustrated, and its corner 66 is blunted by the angled corner area. The user grips the fingertip grip portion of the bar and guides the sharpened, angularly inclined, bevelled edge to controllably cut, trim and shape his mustache hair.

With the cover, that is, either the trough-like or sleeve-like cover used with any of the described devices, a convenient mustache shaping system is provided which is sanitary, sate, easily usable and sufficiently inexpensive that it may be discarded after a limited number of uses.

The foregoing description is meant to be illustrative of operative embodiments of this invention and not in a strictly limiting sense. Thus, this invention may be further developed within the scope of the following claims:

I claim:

1. A small-size lightweight mustache shaving device, grippable between a user's forefinger and thumb for edging and shaping his own mustache hair, comprising:

an elongated, narrow, substantially flat body no more than about two inches long which is divided into a forward head portion and an integral rear fingertip-grip portion, said fingertip-grip portion being of a length approximating the free ends of a typical user's forefinger and thumb;

said forward head portion having an elongated longitudinally extending edge and a centerline parallel to said extending edge;

a flat blade integrally supported in said body, said blade having a straight elongated, razor-sharp edge no more than about three-fourths of an inch long, mounted upon said forward head portion with the sharp edge of the blade extending a short distance laterally outwardly of said elongated edge of said head portion and side edges on each side of said sharp edge angling at an obtuse angle relative to said sharp edge for providing blunting which enables a user to apply greater pressure on said sharp edge to enhance cutting action;

said integral rear fingertip-grip portion having a centerline parallel to the centerline of said forward head portion and offset away from the sharp edge of the blade;

whereby the grip portion may be manually gripped between a user's fingertips and the blade and its supporting head portion may be moved over his mustache hair to be cut and his skin adjacent thereto in order to cut and shape his mustache hair with the sharp edge of the blade.

2. A mustache shaving device as defined in claim 1, and with said blade having a forward end and a rear end and with the intersections of said ends with the sharp edge of the blade being blunted.

3. A mustache shaving device as defined in claim 2, and with a narrow channel formed in the head portion, with the channel extending longitudinally along the head and being parallel to and opening along said elongated edge of said head portion;

and with said blade arranged within and substantially filling the channel for positioning and securing the blade within said head portion with the sharp edge of said blade extending outwardly of the channel opening.

4. A mustache shaving device as defined in claim 3, further including a removable, elongated cover sized to closely fit over and frictionally hold upon the head portion for covering the elongated sharp edge of the blade and the adjacent portions of the head portion during non-use thereof, so that the user may manually apply and remove the cover as desired.

5. A mustache shaving device as defined in claim 1, further including a cover in the form of an elongated plastic member of a length and width to snugly fit over and envelop the elongated exposed sharp edge of the blade and adjacent areas of the head portion, said cover being frictionally engaged upon the head portion and being manually removable and replaceable when desired.

6. A mustache shaving device of small size for shaping mustache hair through manipulation of the device by the tips of a finger and thumb on a hand of a user who is shaping his own mustache with the device, the device comprising:

an elongated, narrow, substantially flat body no more than about two inches long which is divided roughly in half into a forward cutter end portion and an integral rear fingertip-grip portion that is sized to be pinched between a thumb and forefinger of one hand of a user of the device;

said forward end portion having an elongated side and a centerline generally parallel to said elongated side;

a short, flat blade, having a straight, elongated, exposed, razor-sharp edge no more than about three-fourths of an inch long, secured to the forward end portion with the sharp edge of the blade extending substantially the full length of said elongated side of said forward end portion and extending a short distance laterally outwardly of said side and with blunting being provided along at least one end portion of the blade edge to allow a user to apply greater pressure on said sharp edge to enhance cutting action;

said integral rear fingertip-grip portion having a centerline generally offset away from the centerline of the forward end portion;

whereby the rear grip portion of the body of the device may be manually gripped solely between the user's thumb and index fingertip and the forward end portion may then be manipulated over the ends of the mustache hair to be cut for shaping the mustache hair with the razor-sharp edge of the blade.

7. A mustache shaving device as defined in claim 6 wherein the forward end portion includes a main body section having a channel therein for receiving the blade and end body sections located on opposite longitudinal ends of the main body section, which end body sections extend outwardly from the main body section to substantially envelop the forward and rear ends of the blade, the outermost surfaces of the end body sections being blunted in comparison to the blade sharp edge, whereby the forward and rear ends of the blade sharp edge are effectively guarded by the end body sections.

8. A mustache shaving device as defined in claim 6, and having a narrow channel formed in the forward end portion, with the channel opening along said elongated side of said forward end portion;

and with said blade arranged within and substantially filling the channel for positioning and securing the blade to said forward end portion.

9. A mustache shaving device as defined in claim 6, and including a removable, channel-shaped cover sized to closely fit over the end portion elongated side for covering the blade sharp edge during non-use thereof and being frictionally secured to the forward cutter end portion, so that the user may manually apply and remove the cover when desired.

10. A mustache shaving device as defined in claim 6, and including a cover with an elongated channel-shaped plastic molding having opposite closed ends, the cover being of a length and width to snugly fit over and envelop the elongated side of the forward end portion and the exposed sharp edge of the blade; said cover being frictionally engaged upon the end portion and being manually removable and replaceable when desired.

11. A mustache shaving device as defined in claim 6 and with said forward cutter end portion having an exposed surface extending along the length thereof, and with the blade arranged in face-to-face contact with and secured against said exposed surface.

12. A mustache shaving device as in claim 6, wherein the blunting of at least one end portion includes providing a side edge adjacent to said straight elongated sharp edge, with the side edge being at an angle relative to said sharp edge, thus defining a corner area of the blade edge, with the edge of the blade in the corner area being less sharp than the straight sharp edge of the blade.

13. A small lightweight mustache shaving device, designed to be gripped solely by a fingertip and thumb of one hand, for use by a person in precision cutting his own mustache hair that defines the periphery of his mustache, the device comprising:

an elongated, narrow, substantially flat body no more than about two inches long which is divided into a forward head portion and an integral rear fingertip-grip portion;

said head portion having an elongated, longitudinally extending edge and a centerline parallel to said extending edge;

a flat, cutter blade having a straight sharp edge, mounted upon said forward head portion with the sharp edge of the blade extending a short distance laterally outwardly of said extending edge;

said integral rear fingertip-grip portion having a centerline substantially parallel to the centerline of said forward head portion and offset away from the sharp edge of the blade;

said fingertip-grip portion being of a length approximately the length of the free ends of a user's forefinger and thumb;

the grip portion sized to be manually gripped solely between the tips of a user's thumb and forefinger so that the head portion is normally manipulated thereby over the skin surface and hair defining the peripheral edge of the user's mustache for precision shaping the periphery of the mustache to a shape desired by the user.

14. A mustache shaving device as in claim 13, wherein the centerline of the forward head portion and the centerline of the rear grip portion are in substantially the same plane.

15. A mustache shaving device as in claim 13, wherein the sharp edge of the blade is substantially entirely exposed.

16. A mustache shaving device as in claim 13, wherein:

the head portion is a two-piece structure including a first section having a pocket formed therein for receiving a portion of the blade, and a second section which is arranged to be matingly coupled with the first section, thereby holding the blade securely within the pocket; and the blade is a metal strip having at least one razor sharp edge which constitutes the straight elongated sharp edge of the blade; and the blade is assembled into the head portion by inserting the blade into the pocket.

17. A mustache shaving device as in claim 13, wherein the blade is a separate metal blade having only one razor sharp edge, and the blade has an unsharpened edge which extends generally parallel to the razor sharp edge.

18. A small mustache peripheral edge cutting device, for use by a person having a mustache to shape and shave his own mustache by fingertip and thumb manipulation of the device, comprising:

an elongated, narrow, substantially flat body no more than about two inches long which is divided into a forward cutter end portion and an integral rear grip portion;

said forward end portion having an elongated side and a centerline generally parallel to said elongated side;

a flat blade, having a straight elongated sharp edge, secured to said forward cutter end portion with the sharp edge of the blade extending substantially the full length of said elongated side of said forward end portion and extending a short distance laterally outwardly of said side;

said integral rear fingertip-grip portion having a centerline offset from the centerline of said forward end portion in a direction which places the grip portion further away from the sharp edge of the blade;

said rear grip portion being of a length which approximates the length of the fingertip end portions of a user's thumb and forefinger;

said rear grip portion normally being manually grippable between the tips of the user's thumb and forefinger for precision manipulation of the forward end portion and blade edge over his undulating skin and his mustache hair defining the peripheral edge of his mustache for accurately cutting the mustache peripheral edge to a shape desired by him.

19. A mustache shaving device as in claim 18, wherein the cutter end portion includes a main body section having an elongated channel formed therein for holding the blade, and includes a plurality of fingers separated by notches which fingers extend laterally outwardly from the main body section in a direction toward the exposed sharp edge of the blade.

20. A mustache cutting device as in claim 18, wherein the centerline of the forward end portion and the centerline of the rear grip portion are substantially parallel to one another.

* * * * *